US010098468B2

(12) United States Patent
Olsen

(10) Patent No.: US 10,098,468 B2
(45) Date of Patent: Oct. 16, 2018

(54) CUBIC FURNITURE ENSEMBLE

(71) Applicant: Robert J. Olsen, New York, NY (US)

(72) Inventor: Robert J. Olsen, New York, NY (US)

( * ) Notice: Subject to any disclaimer, the term of this patent is extended or adjusted under 35 U.S.C. 154(b) by 0 days.

(21) Appl. No.: 15/638,465

(22) Filed: Jun. 30, 2017

(65) Prior Publication Data

US 2018/0000251 A1 Jan. 4, 2018

Related U.S. Application Data

(60) Provisional application No. 62/357,449, filed on Jul. 1, 2016.

(51) Int. Cl.

| | |
|---|---|
| ***A47C 7/70*** | (2006.01) |
| ***A47C 4/02*** | (2006.01) |
| ***A47C 7/00*** | (2006.01) |
| ***A47C 7/18*** | (2006.01) |
| ***A47C 17/04*** | (2006.01) |
| ***A47B 85/04*** | (2006.01) |
| ***A47C 13/00*** | (2006.01) |
| ***A47C 17/34*** | (2006.01) |
| ***A47C 17/37*** | (2006.01) |
| *A47C 4/00* | (2006.01) |
| *A47B 3/06* | (2006.01) |

(52) U.S. Cl.

CPC ..... *A47C 7/70* (2013.01); *A47B 85/04* (2013.01); *A47C 4/028* (2013.01); *A47C 7/002* (2013.01); *A47C 7/18* (2013.01); *A47C 13/005* (2013.01); *A47C 17/04* (2013.01); *A47C 17/34* (2013.01); *A47C 17/37* (2013.01); *A47B 3/063* (2017.08); *A47C 4/00* (2013.01); *A47C 7/00* (2013.01)

(58) Field of Classification Search

CPC .. A47C 7/70; A47C 7/002; A47C 7/18; A47C 7/00; A47C 4/028; A47C 13/005; A47C 17/04; A47C 17/34; A47C 17/37; A47B 85/04; A47B 3/063

USPC ..... 297/440.14

See application file for complete search history.

(56) References Cited

U.S. PATENT DOCUMENTS

| | | | | | |
|---|---|---|---|---|---|
| 3,706,473 | A | * | 12/1972 | Mullen | A47B 87/007 297/118 |
| 3,773,329 | A | * | 11/1973 | Secter | A47C 13/005 273/153 R |
| 5,509,720 | A | * | 4/1996 | Croom | A47C 13/005 297/181 |
| 6,063,007 | A | * | 5/2000 | Sithole | A63B 23/0458 297/440.14 |

(Continued)

OTHER PUBLICATIONS

<https://www.youtube.com/watch?v=8Gcukakmbrl>, Feb. 21, 2013.*

*Primary Examiner* — Mark R Wendell

(74) *Attorney, Agent, or Firm* — Carter, DeLuca, Farrell & Schmidt, LLP

(57) ABSTRACT

A furniture device is disclosed comprising six individual pieces that interconnect to form a cube. The pieces include two substantially L-shaped side portions, one substantially L-shaped central portion adapted to fit between the two substantially L-shaped side portions, a substantially L-shaped top portion adapted to fit between the two substantially L-shaped side portions and on top of the substantially L-shaped central portion, and two arc-sided rectangle portions adapted to fit between the substantially L-shaped top portion and substantially L-shaped central portion. The six pieces can be arranged in a various forms.

20 Claims, 12 Drawing Sheets

(56) References Cited

U.S. PATENT DOCUMENTS

| | | | | |
|---|---|---|---|---|
| 6,824,220 | B1 * | 11/2004 | Davison | A47C 13/005 297/233 |
| 7,020,911 | B2 * | 4/2006 | Oldham | A47C 13/005 297/411.24 |
| 7,481,496 | B2 * | 1/2009 | Smith | A47B 83/02 297/440.1 |
| 2008/0284228 | A1 * | 11/2008 | Smith | A47B 83/02 297/440.14 |
| 2012/0119629 | A1 * | 5/2012 | Nelson | A47B 87/00 312/111 |
| 2016/0324321 | A1 * | 11/2016 | George, II | A47C 5/12 |

* cited by examiner

1 TO 3 + CHAIR ASSEMBLY
1"TO 1" "THE PUZZLE CUBE"

CUBIC FURNITURE ENSEMBLE

CROSS REFERENCE TO RELATED APPLICATIONS

This application claims the benefit of U.S. Provisional Application No. 62/357,449, filed Jul. 1, 2016, the entire contents of which are incorporated by reference herein.

TECHNICAL FIELD

The present disclosure relates to furniture and, more particularly, to portable furniture.

BACKGROUND

Furniture refers to movable objects intended to support various human activities such as seating (e.g., chairs, stools, and sofas), eating (e.g., tables), and sleeping (e.g., beds). Furniture is also used to hold objects at a convenient height for work (e.g., desks), or to store things (e.g., cupboards and shelves). Furniture can be a product of design and is considered a form of decorative art.

SUMMARY

There is a need for inexpensive, portable furniture items suitable for children's rooms, dormitories, play rooms, vacation homes and the like. Such furniture should be compact (may be scaled from 18" to 36" or larger) and light weight to facilitate transportation and storage. Such furniture should also be easy to handle, have versatile configurations in order to give users the freedom to create their own seating forms that meet their needs and creative expression and otherwise be well suited to its intended functions. To answer these needs in the field, the presently disclosed furniture ensemble, is comprised of six separate pieces that can be arranged in various configurations, including individually, and/or in various groupings. In embodiments, the furniture ensemble may be arranged in a puzzle cube form. Such pieces may be formed of solid flexible material. In embodiments, such furniture may have suitable protective covers for its constituent pieces.

The furniture ensemble may be crafted from a cubic block of material such as polyurethane foam or the like. This furniture ensemble may be crafted from a single cube of material which can be sliced or otherwise divided in to six pieces. Using every bit of the material, the six pieces can be reassembled to from a cube. By this method, the six pieces can be made compact for transportation of storage.

The six pieces comprise two substantially L-shaped side portions, one substantially L-shaped central portion adapted to fit between the two substantially L-shaped side portions, a substantially L-shaped top portion adapted to fit between the two substantially L-shaped side portions and on top of the substantially L-shaped central portions, and two arc sided rectangle portions adapted to fit between the substantially L-shaped top portion and the substantially L-shaped central.

Alternatively, the six pieces may comprise two substantially L-shaped side portions and one block-shaped central portion, e.g. a central block. This central block is further comprised of a bottom portion, a top portion, both substantially L-shaped and adapted to fit between the two substantially L-shaped side portions, an arc sided rectangle portion divided in two identical parts adapted to fit between the substantially L-shaped top portion and the substantially L-shaped bottom portion.

The six pieces can be arranged in various forms to provide one or more seating, a tool, pillows and the like. Because of their shapes, these forms can be used as a cushion for performing gymnastic activities such as front rolls or flips. Additionally, the six pieces can be arranged to from a desk with a seat, a bench with a console divider/arm rest, an airplane cockpit lounge with side wing seating, a reclining lounge, a gaming table, a basketball like game, a bed with pillows, a platform with seating, a cave, quiet chamber, and/or create a freeform seating arrangements using the pieces in ways only limited by the imagination of users.

BRIEF DESCRIPTION OF THE DRAWINGS

The accompanying drawings, which are incorporated in and constitute a part of this specification, illustrate embodiments of the disclosure and, together with a general description of the disclosure given above, and the detailed description given below, serve to explain the principles of the disclosure, wherein.

DETAILED DESCRIPTION

Figure 1:
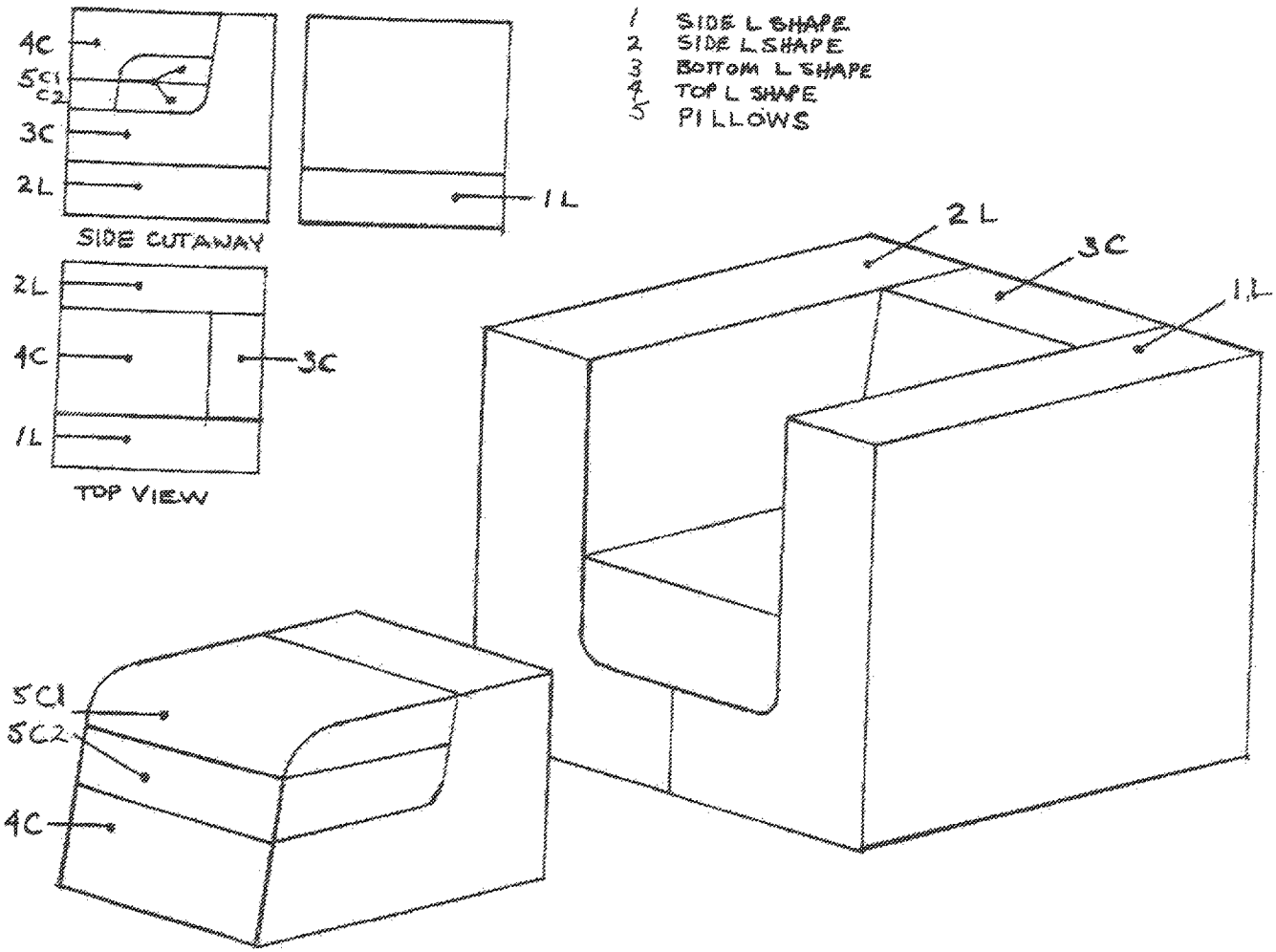
FIG. 1 shows a cube of starting material and how it is formed into the presently disclosed furniture ensemble having a single seat with arm rests, a foot stool, and two pillows.

Embodiments of the present disclosure are described in detail with reference to the drawings, in which like reference numerals designate identical or corresponding elements in each of the several views. In the following description, well-known functions or constructions are not described in detail to avoid obscuring the present disclosure in unnecessary detail.

With reference to FIGS. 1-12, the presently disclosed furniture ensemble, or furniture cube is comprised of six interconnected pieces that come together to form a cube. The interconnected pieces include two substantially L-shaped sides portions 1L and 2L, one substantially L-shaped central portion 3C adapted to fit between the two substantially L-shaped side portions 1L and 2L, and a substantially L-shaped top portion 4C to fit between the two substantially L-shaped side portions 1L and 2L on the top of the substantially L-shaped central portion 3C, with arc side rectangle portions 5C1 and 5C2 adapted to fit between the substantially L-shaped top portion 4C and the substantially L-shaped central portion 3C.

The pieces that form the furniture ensemble may further comprise contact surfaces wherein the various portions come in contact with each other and the contact surfaces further comprise complimentary connectors such as hook and loop type. In this way the cube will stay together when being moved around. The connectors will also add stability when the furniture device (s) is placed in its other configurations. The connectors may include snaps, magnets, buttons, etc., or combinations thereof.

The furniture ensemble could be crafted from various solid materials including wood, wood produces, plastics, such as Polyurethane foam, or combinations thereof. The finish on this furniture ensemble is flexible. Each piece of the furniture ensemble may be enclosed in covers with a closure mechanism, such as zippers, buttons, etc., along their edges. The covers may be made from any suitable upholstery fabric, for example, a heavy-weight cotton fabric such as denim. Plastic covers or elastic materials may also be used. Covers are provided to snugly enclose their respective pieces.

The individual pieces of the furniture ensemble fit together into their original cubic assembly for ease of transportation and/or storage. There is only one way to assemble the pieces into a cube, giving the product a puzzle characteristic which may prove enjoyable and educational, especially for spatial leaning concerning special needs children.

While the pieces can only come together to from a cube in only one way, the pieces can be used in an almost endless variety, when separated from the cube configuration. Some of the various uses are illustrated in the attached figures. For example, FIG. 1 shows the substantially L-Shaped top portion 4C and the arc-sided rectangle portions 5C1 and 5C2 separated from the rest of the ensemble (cube) and so to act as an accompanying stool or ottoman.

Figure 2:
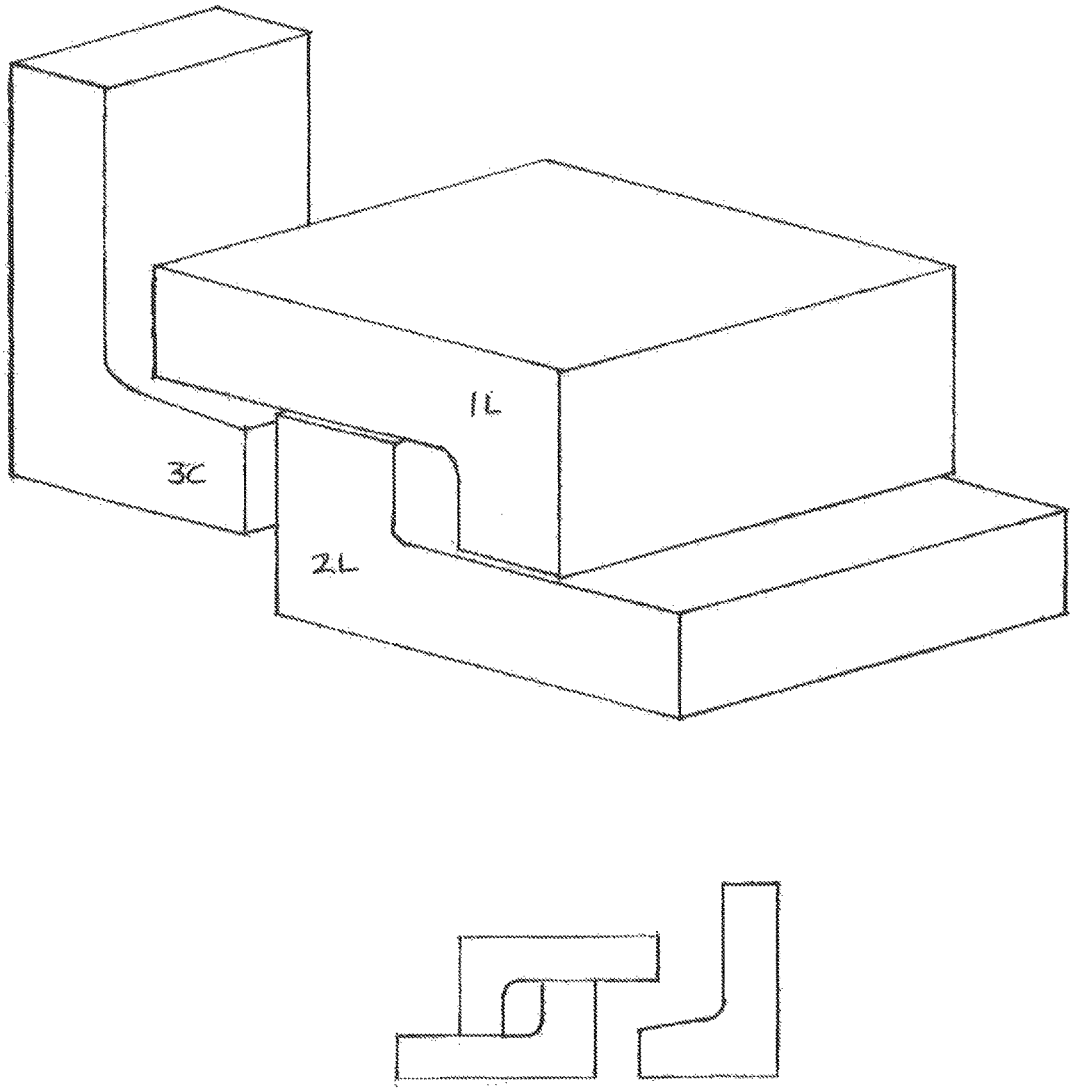
FIG. 2 illustrates the furniture ensemble in one configuration having a desk with a seat in perspective and in a side elevated view.

FIG. 2 shows the two substantially L-shaped side portions 1L and 2L interlocked to form a working surface or desk, accompanied by the sub-satanically L-Shaped center portion used as a seat, together forming a workspace, desk and seat. In the desk with chair configuration, substantially L-shaped side portions 1L and 2L are on top of one another to form a cantilever desk or work surface that can be adjusted in depth with L-shaped central portion 3C serving as a chair.

Figure 7:
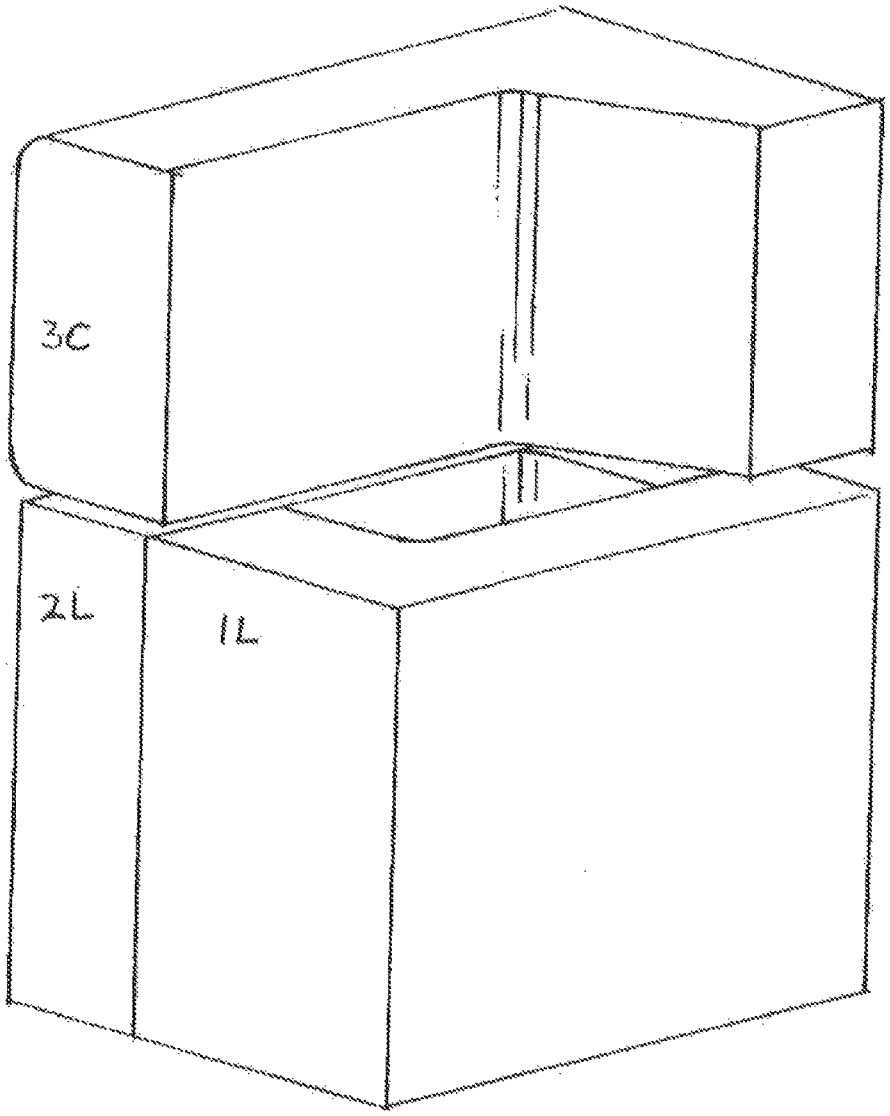
FIG. 7 illustrates the furniture ensemble in one configuration in which three L-shaped pieces are arranged to create a basketball hoop or chamber for playing ball.

In certain configurations, the exact pieces in FIG. 2 can be used on their ends by rotating them 90 degrees to form a basketball like game, FIG. 7, with little adjustment. This shows a unique versatility and multifunction.

Figure 3:
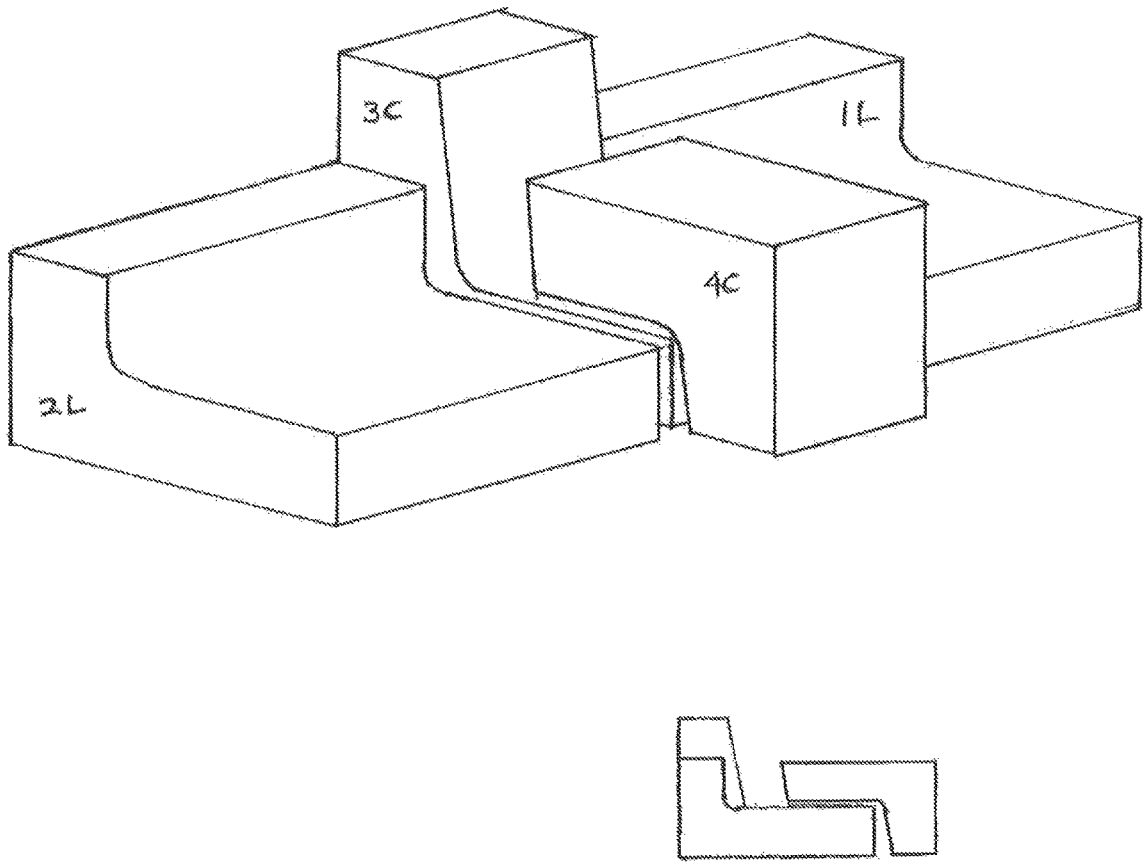
FIG. 3 is a perspective view of the furniture ensemble in another configuration illustrating how four of the pieces of the furniture ensemble can be assembled to from a bench seat with a console; a side elevated view is also shown.
Figure 4:
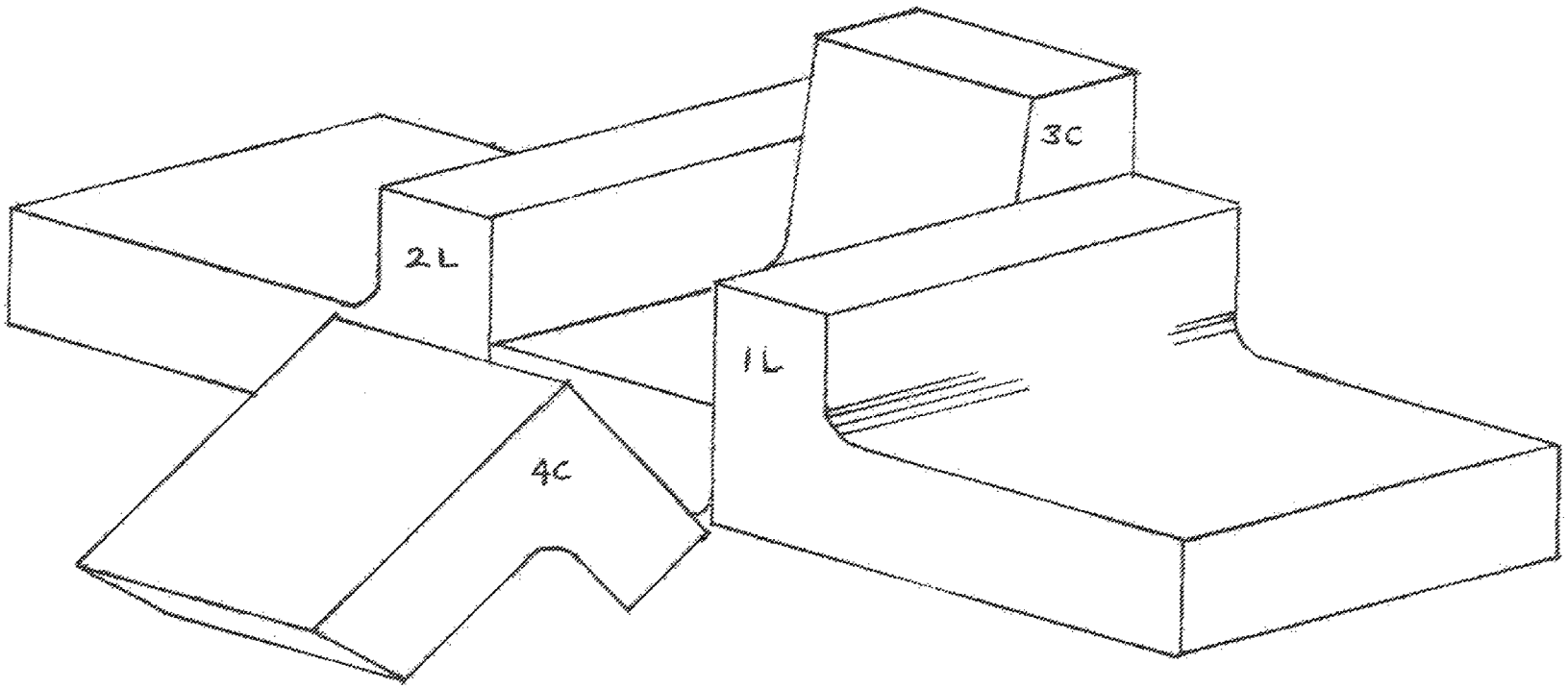
FIG. 4 shows the furniture ensemble in yet another configuration that is a simulation of an airplane cockpit lounge with arm rests, leg rest and side wing seating.

FIG. 3 shows the substantially L-shaped central portion 3C placed between both L-shaped side portions 1L and 2L with L-shaped top portion 4C forming a console/table. This configuration forms a bench seat with console table. FIG. 4 shows an airplane lounge configuration with the central portion 3C flanked by the two L-shaped side portions 1L and 2L. The top portion 4C is arranged in line with the central portion 3C to form a foot rest/ottoman. This configuration includes arm rests having side lounge seating to allow others to seat very close on either side of the central occupant and look at pictures/movies/illustrations along with a central occupant. This configuration allows others to seat close to the central occupant (e.g. during children's story time) to see illustrations and be close to the reader.

Figure 5:
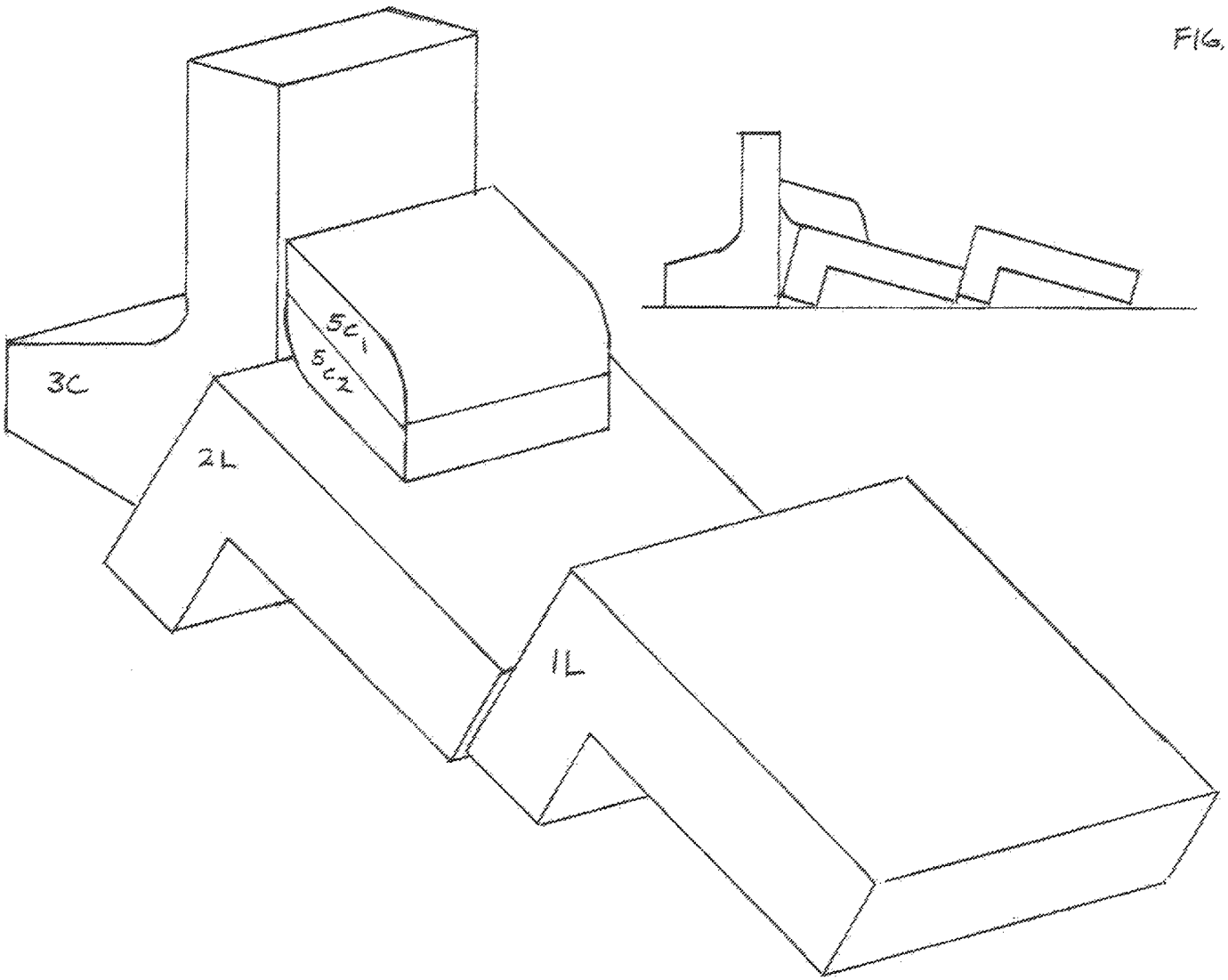
FIG. 5 illustrates the furniture ensemble in one configuration that is a reclining lounge suitable for watching television or playing video games, using three L-Shaped pieces and a pillow.

FIG. 5 shows a reclining lounge configuration in which the L-shaped side portions 1L and 2L are turned upside down and placed in-line and placed against the back side of the central portion 3C creating a seat adapted for reclining and a seat for upright sitting. The arc-sided rectangle portions 5C1 and 5C2 are used as pillows for the reclining seat.

Figure 6:
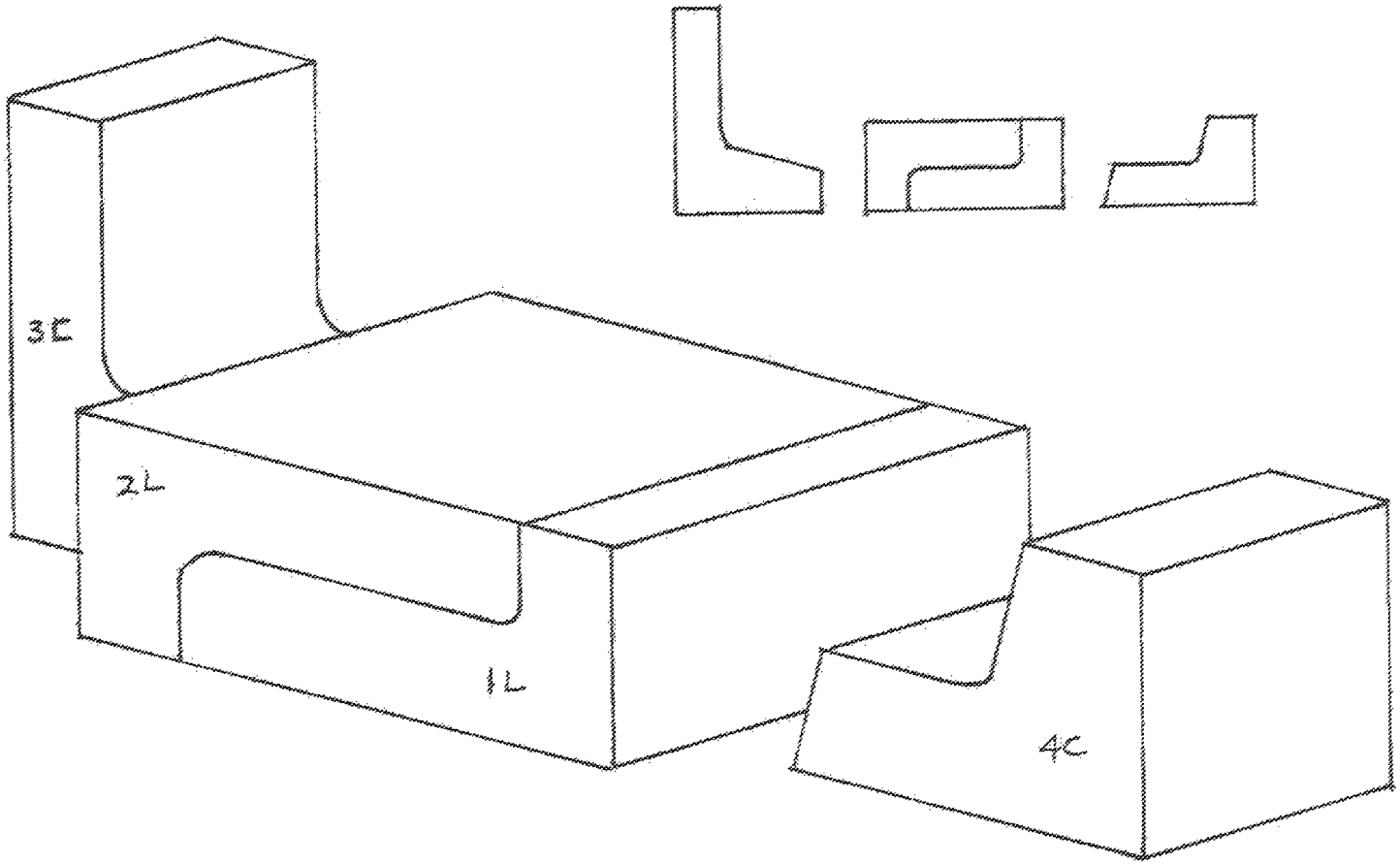
FIG. 6 shows the furniture ensemble in another configuration that is a gaming table with two seats (games may be printed or attached to the surfaces by any means who is skilled in the art)

FIG. 6 shows a gaming table configuration. In this configuration, the two L-shaped side portions 1L and 2L are fit together to form a rectangle. The central portion 3C and top portion 4C are placed adjacent to the rectangle and can be used as seats. The surfaces of the L-shaped side portions 1L and 2L may have game elements printed on them, such as checkers, chess, dart board, bean bag with hook-and-loop and target, etc.

FIG. 7 shows the device in a configuration adapted for a basketball like game wherein the two L-shaped side portions 1L and 2L interlocked such that, they define a cavity, the central portion 3C is placed atop the interlocked L-shaped side portions 1L and 2L to from a functional (backboard).

Figure 8:
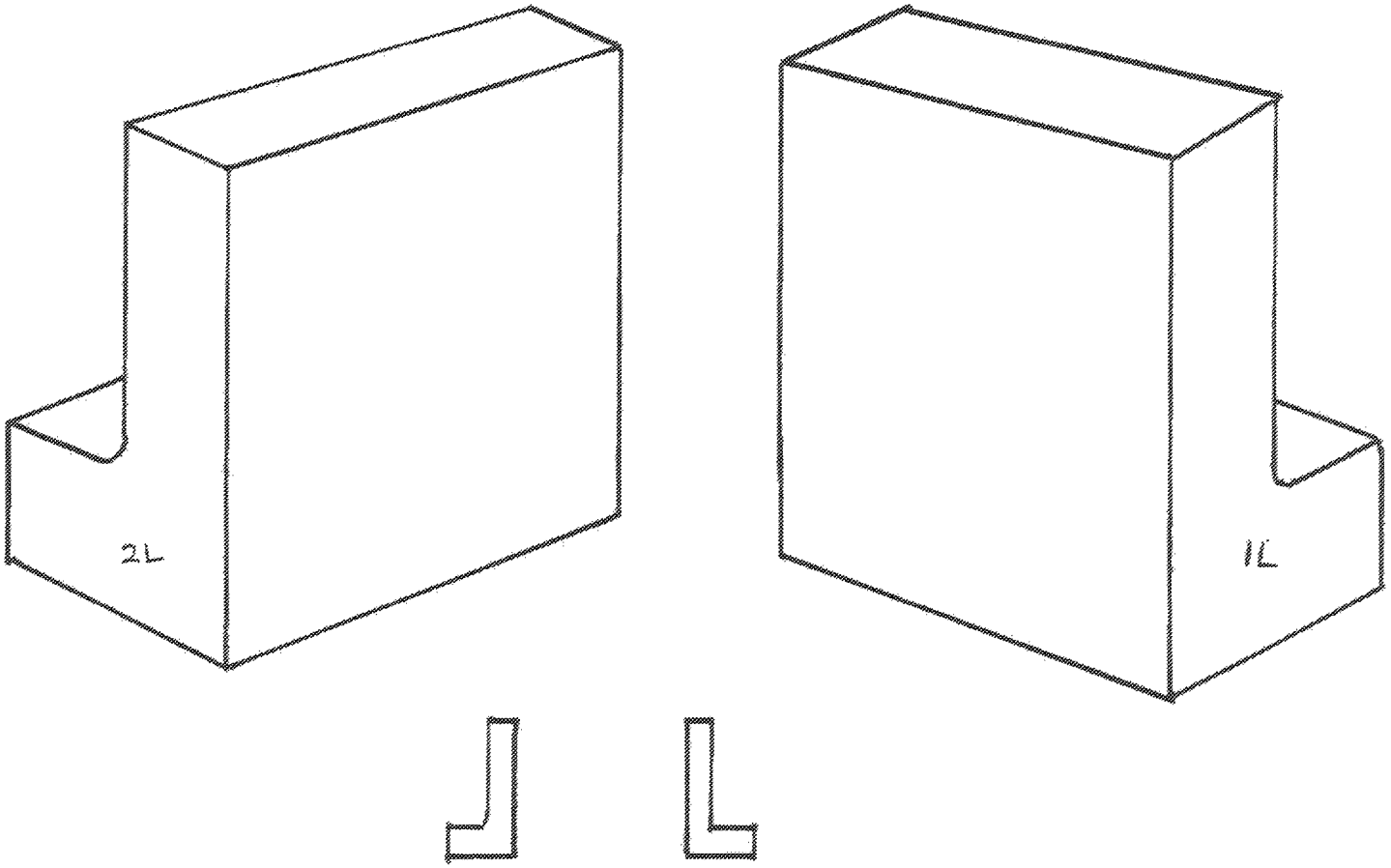
FIG. 8 shows the furniture ensemble in another configuration in which the L-Shaped pieces can be used in play as barriers behind which to hide.

FIG. 8 shows how the L-shaped side portions 1L and 2L can be placed upright and create places to "hide" behind.

Figure 9:
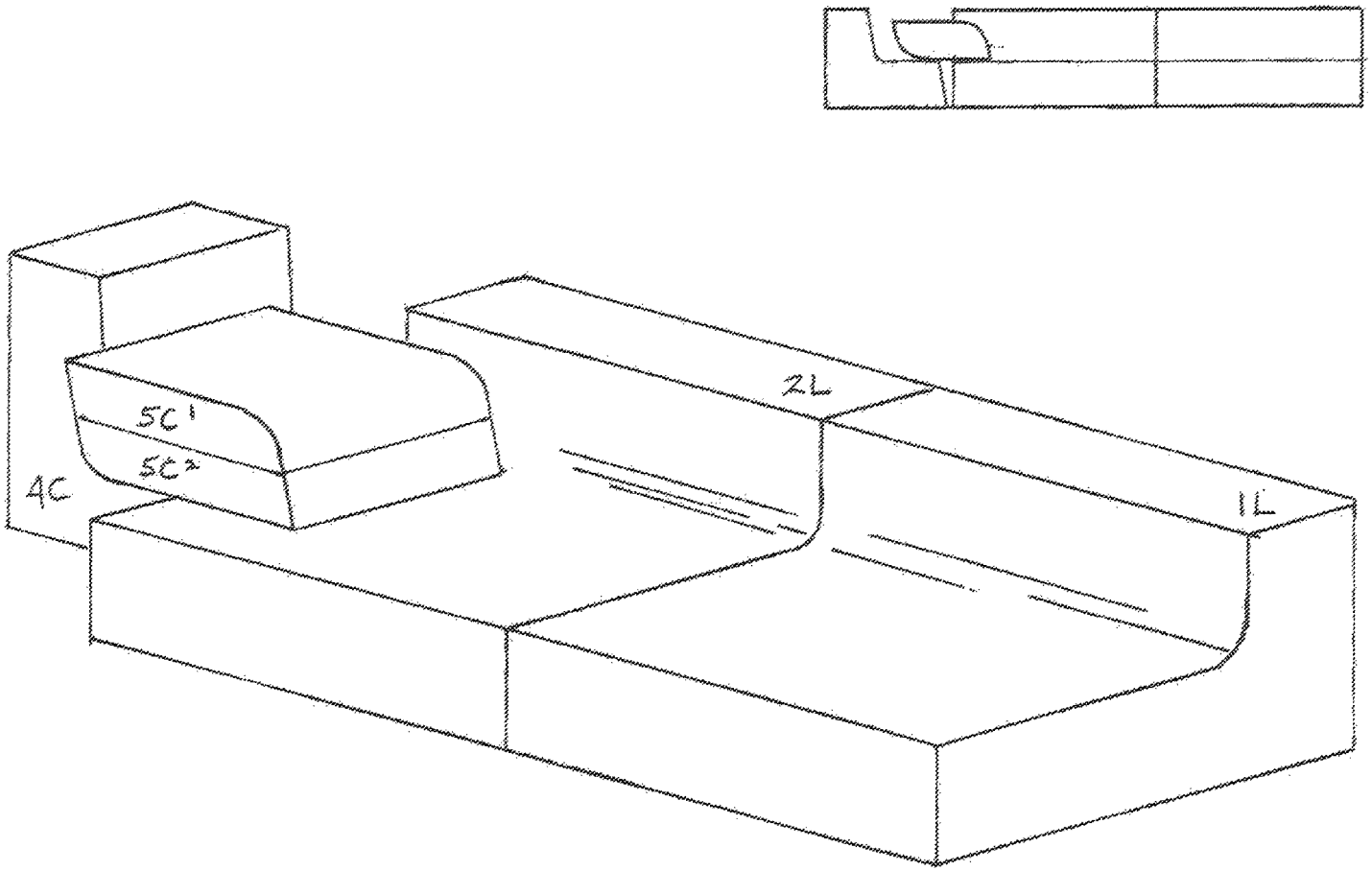
FIG. 9 is another configuration of the furniture ensemble and shows a perspective view of two L-shaped pieces with a pillow to serve as a bed (a third piece can be added at one end for a taller person, as showed in a side elevated view)

FIG. 9 shows the two L-shaped side portions 1L and 2L placed side-by-side with the arc-sided rectangle portions 5C1 and 5C2 placed atop. This configuration forms a bed and pillows.

Figure 10:
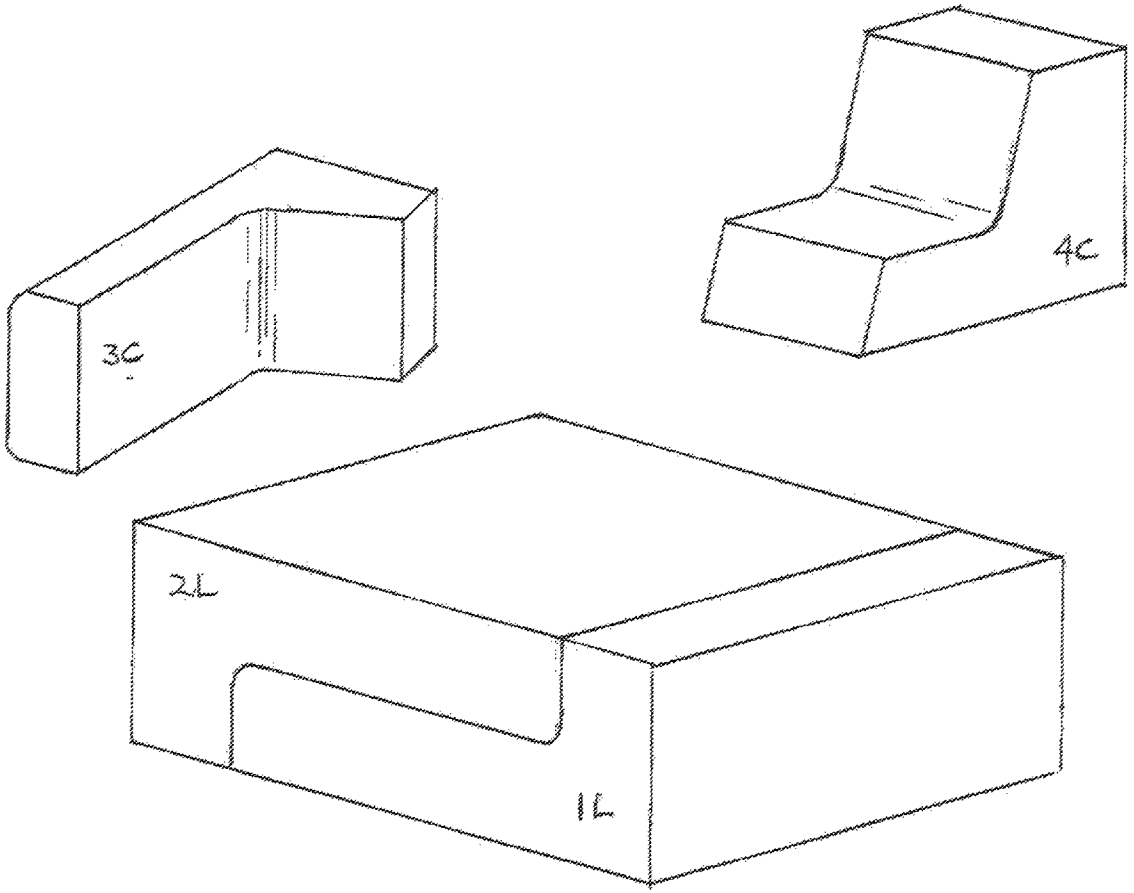
FIG. 10 is a perspective view of the furniture ensemble in another configuration that is a platform stage with lounge seating supports to be leaned against for play and performance.

FIG. 10 shows the two L-shaped side portions 1L and 2L interlocked to form a platform to be used as a stage, wherein the central portion 3C and the top portion 4C are used as seating and or backrests.

Figure 11:
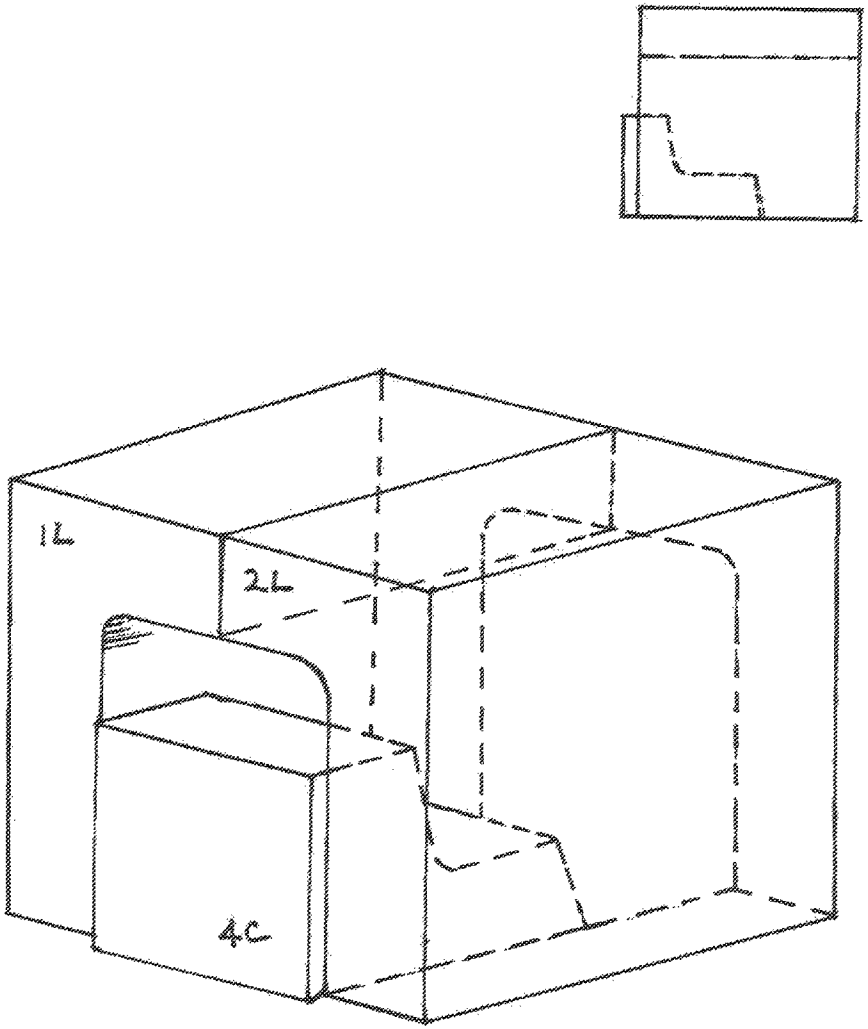
FIG. 11 shows use of pieces of the furniture ensemble to a form a play cave or tunnel or quiet space.

FIG. 11 shows the furniture ensemble with the central portion 3C removed and short ends of the L-shaped side portions 1L and 2L touching therein to define a cavity. In this configuration, the ensemble can be used as a cave, hiding place or quiet chamber since the soft internal material of the pieces are configured act a sound barrier by absorbing sound waves.

Figure 12:
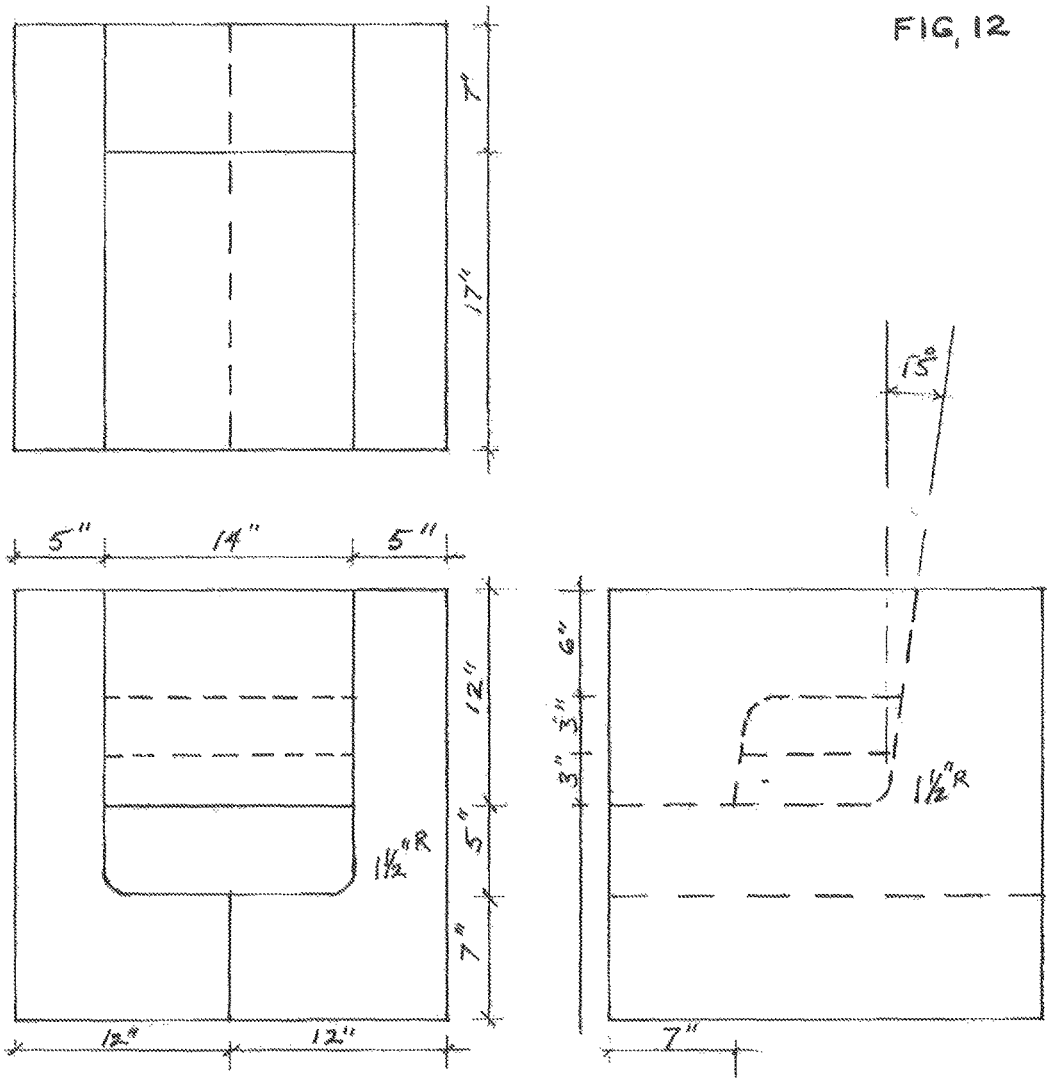
FIG. 12 shows exemplary measurements of pieces of the furniture ensemble.

FIG. 12 shows exemplary measurements for the cutting of the cube material of the furniture ensemble into the interlocking portions, although any suitable dimensions may be provided.

Persons skilled in the art will understand that the structures and methods specifically described herein and shown in the accompanying figures are non-limiting exemplary embodiments, and that the description, disclosure, and figures should be construed merely as exemplary of particular embodiments. It is to be understood, therefore, that the present disclosure is not limited to the precise embodiments described, and that various other changes and modifications may be effected by one skilled in the art without departing from the scope or spirit of the disclosure. Additionally, the elements and features shown or described in connection with certain embodiments may be combined with the elements and features of certain other embodiments without departing from the scope of the present disclosure, and that such modifications and variations are also included within the scope of the present disclosure. Accordingly, the subject matter of the present disclosure is not limited by what has been particularly shown and described.

The invention claimed is:

1. A furniture ensemble, comprising:

a cube comprised of six individual portions, the six individual portions further comprising four L-shaped portions and two arc-sided rectangle portions, the four L-shaped portions further comprising, two L-shaped side-portions, one L-shaped central portion adapted to fit between the two L-shaped side-portions, a top L-shaped portion adapted to hold the two arc-sided rectangles between the L-shaped central portion and the top L-shaped portion, wherein the six individual portions fit together to form a cube, wherein at least two of the four L-shaped portions have different geometries.

2. The furniture ensemble of claim 1, wherein each of the six individual portions includes polyurethane.

3. The furniture ensemble of the claim 1, wherein each of the six individual portions is encased in a cover or coating.

4. The furniture ensemble of claim 3, wherein the cover includes denim or a blend of fabrics.

5. The furniture ensemble of claim 1, wherein each of the six individual portions includes at least one connector that couples at least one connector of the other individual portions.

6. The furniture ensemble of claim 5, wherein each of the connectors includes a hook-and-loop, a button, a loop, a tab, a snap, a magnet, or combinations thereof.

7. The furniture ensemble of claim 1, wherein the L-shaped central portion, when positioned between the two L-shaped side portions, forms a seat with side arm rests such that short sides of the L-shaped side portions are touching each other and trapped under the L-shaped central portion.

8. The furniture ensemble of claim 1, wherein the two L-shaped side-portions have the same geometry.

9. The furniture ensemble of claim 1, wherein the top L-shaped portion has different geometry than the L-shaped central portion.

10. The furniture ensemble of claim 1, wherein the top L-shaped portion has different geometry than at least one of the two L-shaped side-portions.

11. The furniture ensemble of claim 10, wherein the top L-shaped portion has different geometry than the two L-shaped side-portions and the L-shaped central portion.

12. The furniture ensemble of claim 11, wherein the two L-shaped side-portions have the same geometry.

13. The furniture ensemble of claim 12, wherein the two L-shaped side-portions have a different geometry than the L-shaped central portion.

14. The furniture ensemble of claim 13, wherein at least one of the two arc-sided rectangle portions has different geometry than each of the four L-shaped portions.

15. The furniture ensemble of claim 1, wherein the six individual portions are formed from the cube.

16. The furniture ensemble of claim 1, wherein the cube has a solid configuration when the six individual portions are interconnected.

17. A furniture cube, comprising:

six individual pieces that interconnect to form a cube, the six individual pieces comprising two substantially L-shaped side portions having a first geometry, one substantially L-shaped top portion having a second geometry and adapted to fit between the two substantially L-shape side portions and on top of a substantially L-shaped central portion having a third geometry, and two arc-sided rectangle portions adapted to fit between the substantially L-shaped top portion and the substantially L-shaped central portion, wherein the first geometry is different from at least one of the second geometry or the third geometry.

18. The furniture cube of claim 17, wherein the first geometry, the second geometry, and the third geometry different from one another.

19. The furniture cube of claim 18, wherein at least one of the two arc-sided rectangle portions has a fourth geometry that is different from the first, second, and third geometries.

20. The furniture cube of claim 17, wherein all faces of the cube are closed when the six individual pieces are interconnected such that the cube has a solid configuration.

* * * * *